US006244180B1

(12) United States Patent
Winston

(10) Patent No.: US 6,244,180 B1
(45) Date of Patent: Jun. 12, 2001

(54) INK STAMPING SYSTEMS AND METHODS

(76) Inventor: Jeffrey M. Winston, 658 W. Shore Dr., Anacortes, WA (US) 98221

( * ) Notice: Subject to any disclaimer, the term of this patent is extended or adjusted under 35 U.S.C. 154(b) by 0 days.

(21) Appl. No.: 09/311,976

(22) Filed: May 14, 1999

Related U.S. Application Data

(60) Provisional application No. 60/085,716, filed on May 15, 1998.

(51) Int. Cl.[7] ..... B41K 1/56

(52) U.S. Cl. ..... 101/405; 101/125; 101/126; 101/127; 101/127.1; 101/128; 101/281.1; 101/327; 101/333; 101/103; 101/109; 206/1.7; 206/1.8; 206/1.9; 206/575

(58) Field of Search ..... 101/405, 406, 101/125, 126, 127, 127.1, 128, 128.1, 129, 333, 103, 109, 327; 206/1.7, 1.8, 1.9, 214, 223, 224, 575

(56) References Cited

U.S. PATENT DOCUMENTS

| | | | | |
|---|---|---|---|---|
| 2,819,668 | * | 1/1958 | McAneny | 101/405 X |
| 2,899,895 | * | 8/1959 | Tannery | 101/405 X |
| 3,302,566 | * | 2/1967 | Blanchet | 101/405 |
| 3,388,662 | * | 6/1968 | Ravreby | 101/405 |
| 5,435,245 | * | 7/1995 | Salisbury et al. | 101/328 |

* cited by examiner

*Primary Examiner*—John S. Hilten
*Assistant Examiner*—Minh Chau
(74) *Attorney, Agent, or Firm*—Michael R. Schacht; Hughes & Schacht, PLLC

(57) ABSTRACT

A system for forming artistic ink impressions. A case stores ink stamping accessories and/or allows large surface area stamps to be used.

13 Claims, 14 Drawing Sheets

INK STAMPING SYSTEMS AND METHODS

RELATED APPLICATIONS

This application claims priority of Provisional Application No. 60/085,716 filed on May 15, 1998.

FIELD OF THE INVENTION

The present invention relates to systems and methods for forming ink impressions on paper and, more specifically, to such systems and methods that organize the ink stamping process and which may be adapted to facilitate the formation of ink impressions using a rubber stamp having a relatively large surface area printing surface.

BACKGROUND OF THE INVENTION

The present invention relates ink stamping systems and methods in which an ink impression is formed on an impression carrying member. The ink is applied to a stamp member on which a design is formed in bas relief. The stamp member with ink thereon is brought into contact with the carrying member such that ink is transferred to the carrying member to form an ink impression in a configuration corresponding to the design on the stamp member.

The present invention is of particular importance in the formation of artistic rather than commercial ink impressions. In commercial ink stamping, the message conveyed, and not the quality of the ink impression, is of primary importance. A poor quality ink impression of a word such as the term "confidential" is a prototypical example of a commercial ink impression. In contrast, in art stamping the quality of the ink impression is of primary importance. Art stamping thus uses the same basic ink stamping process as commercial ink stamping but has evolved to allow much finer control over the details and quality of the resulting ink impression.

Ink stamping systems for use by art stampers are thus designed and constructed primarily to obtain a high quality ink impression, with flexibility of use also being of importance. Considerations such as repeatability of the ink impression, ease of use, and durability of the stamping devices are of lesser importance than in the commercial ink stamping environment.

The need thus exists for systems and methods that provide art stampers with substantial flexibility in creating high quality ink impressions, and in particular to apply these design goals to the creation of relatively large ink impressions.

SUMMARY OF THE INVENTION

The present invention is a system for and method of organizing art stamping tools. The tools are held in a case that organizes the tools for easy removal. The case may also form a platform for holding an image carrying member in a manner that facilitates the formation of relatively large ink impressions on the image carrying member.

DETAILED DESCRIPTION OF THE PREFERRED EMBODIMENTS

Figure 1:
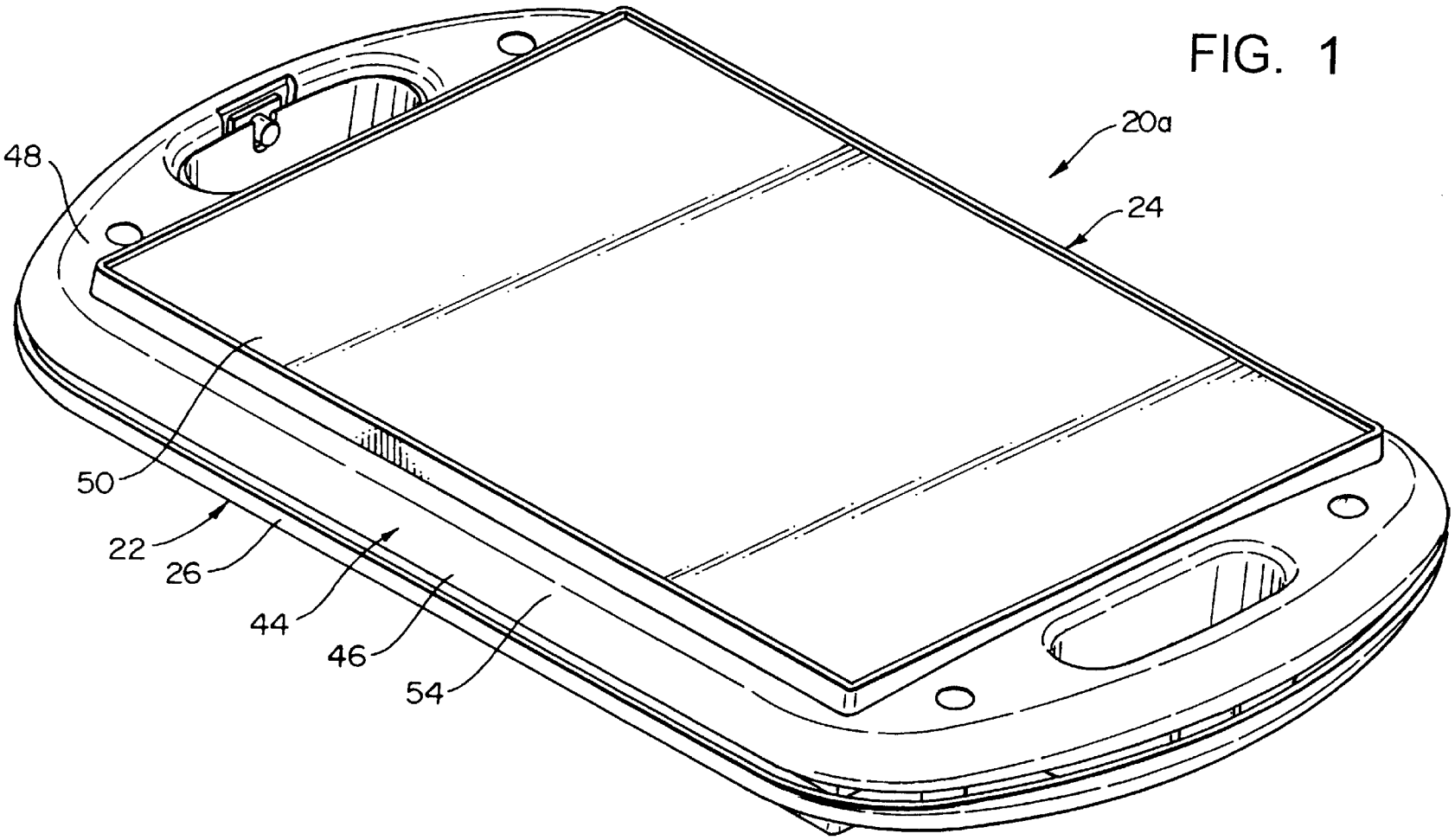
FIG. 1 is perspective view depicting a first mode of using the system of the present invention.
Figure 19:
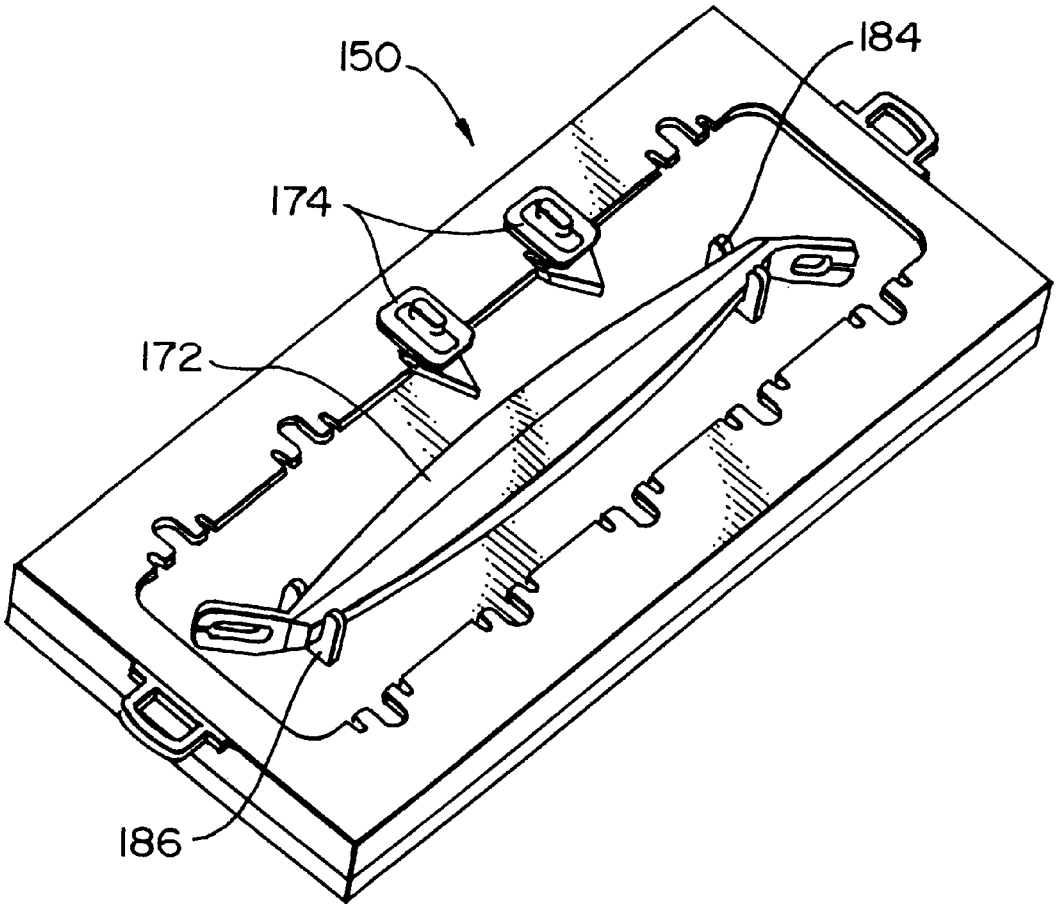
FIG. 19 is a perspective view of a staging tray.

Referring initially to FIGS. 1 and 19, depicted therein is a ink stamping system 20 constructed in accordance with, and embodying, the principles of the present invention. This system 20 operates in a first mode as shown by reference character 20*a* in FIG. 1 and in a second mode as shown by reference character 20*b* in FIG. 19. In the first mode 20*a*, the system 20 functions as a carrying case and organizer for ink stamps and ink stamp accessories. In the second mode 20*b*, the system 20 functions as a stamping assembly that allows large surface area ink stamps to be used to form impressions on sheet material such as paper. From the following discussion, it should be clear that the present invention may be embodied as a product that operates solely in one or the other of these modes 20*a* and 20*b*.

Figure 2:
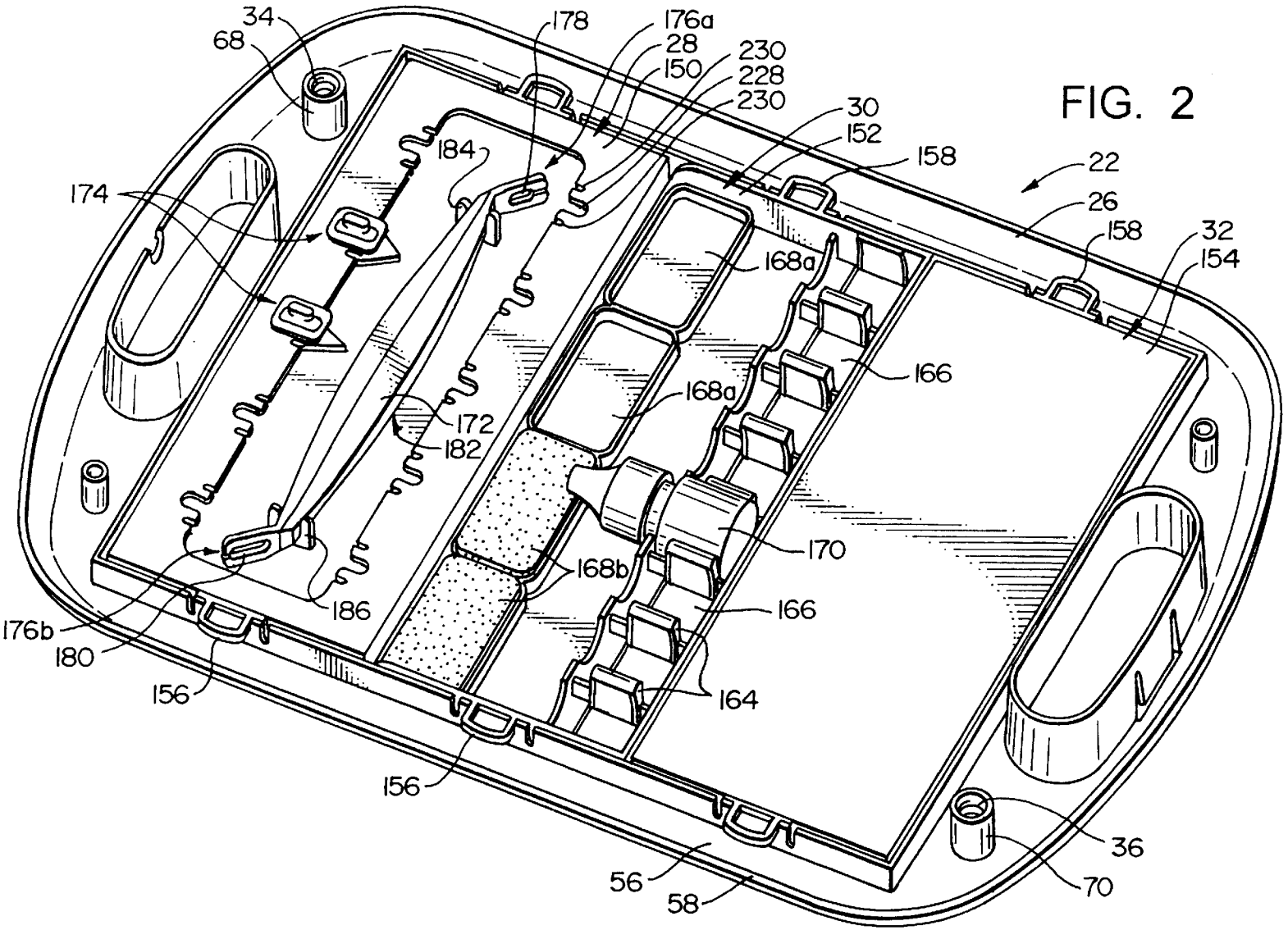
FIG. 2 is a perspective view depicting the system of FIG. 1 with its removed.

Referring initially to FIGS. 1–18, the operation of the system 20 in its first mode 20*a* will be discussed. In the first mode 20*a*, the system 20 comprises a base assembly 22 and a lid member 24. FIG. 2 shows that the base 22 comprises a base member 26, first, second, and third tray members 28, 30, and 32, and first and second standoff springs 34 and 36.

The base member 26 and lid member 24 are, in the preferred embodiment, identical to each other. These members need not be identical, but making them identical reduces tooling and inventory costs and is thus preferred. Only the lid member 24 will be described in detail herein with the understanding that this description also applies to the base member 26. The same reference characters and terminology used to describe the base member 24 will be used in the discussion of the base member 26 when the function of the base member 26 is discussed below.

Figure 3:
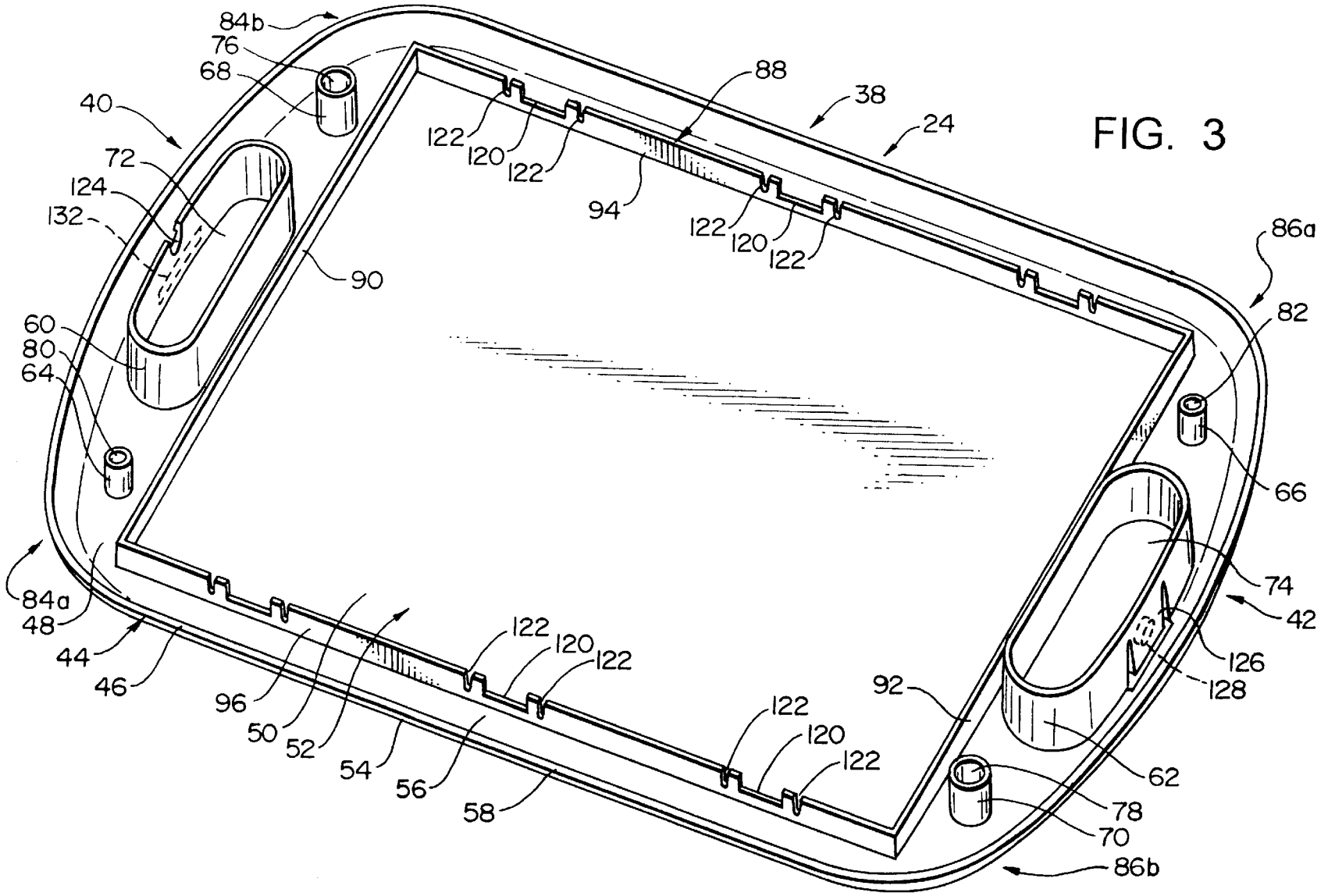
FIG. 3 is a perspective view depicting an interchangeable base/lid ember of the system of FIG. 1.

Referring now to FIG. 3, depicted therein is the inside of the lid member 24. The exemplary lid member 24 is an injection molded part having a central portion 38, first handle portion 40, and second handle portion 42. Referring to both FIG. 1 and FIG. 3, it can be seen that the lid member 24 has an external wall 44 having an outer flange portion 46, a bridge portion 48, and a box portion 50. The bridge portion 48 extends between the flange portion 46 and the box portion 50. The flange portion 46 may be contoured to provide a finished look, and the box portion 50 defines an internal cavity 52 the function of which varies as will be described in further detail below. The external wall 44 has an external surface 54, an internal surface 56, and a perimeter edge 58.

Extending from the internal surface 56 of the bridge portion 48 of the wall 44 are first and second handle guides 60 and 62, first and second posts 64 and 66, and first and second sockets 68 and 70. The handle guides 60 and 62 define handle passageways 72 and 74. The sockets 68 and 70 define socket chambers 76 and 78. The posts 64 and 66 may be solid, but define post chambers 80 and 82 in the exemplary lid member 24. The posts 64 and 66 are located on opposing first and second corners 84*a* and 86*a* of the lid member 24. Similarly, the sockets 68 and 70 are located on opposing third and fourth corners 84*b* and 86*b*. The handle guides 60 and 62 are located on the opposite ends 40 and 42, respectively.

Extending from the internal surface 56 of the box portion 50 of the wall 44 is an inner flange 88 having first and second end portions 90 and 92 and first and second side portions 94 and 96. The inner flange 88 extends around the internal cavity 52, with its end and side portions 90–96 arranged in a rectangular configuration. The first and second end portions 90 and 92 are adjacent to the first and second handle guides 60 and 62, respectively.

Formed on the first and second side portions 94 and 96 are a plurality of attachment slots 120; a pair of relief grooves 122 are formed on either side of each slot 120. When the part shown in FIG. 3 is used as the lid member 24, these slots 120 and grooves 122 are not used. They are used, as will be described below, when this part functions as the base member 26.

A latch slot 124 is integrally formed in the first handle guide 60, while a latch member 126 is integrally formed with the second handle guide 62. Extending from the latch member 126 into the handle guide passageway 74 is a release projection 128 and a detent projection 130. A detent groove 132 is formed in the first handle guide 60 below the latch slot 124.

Figure 4:
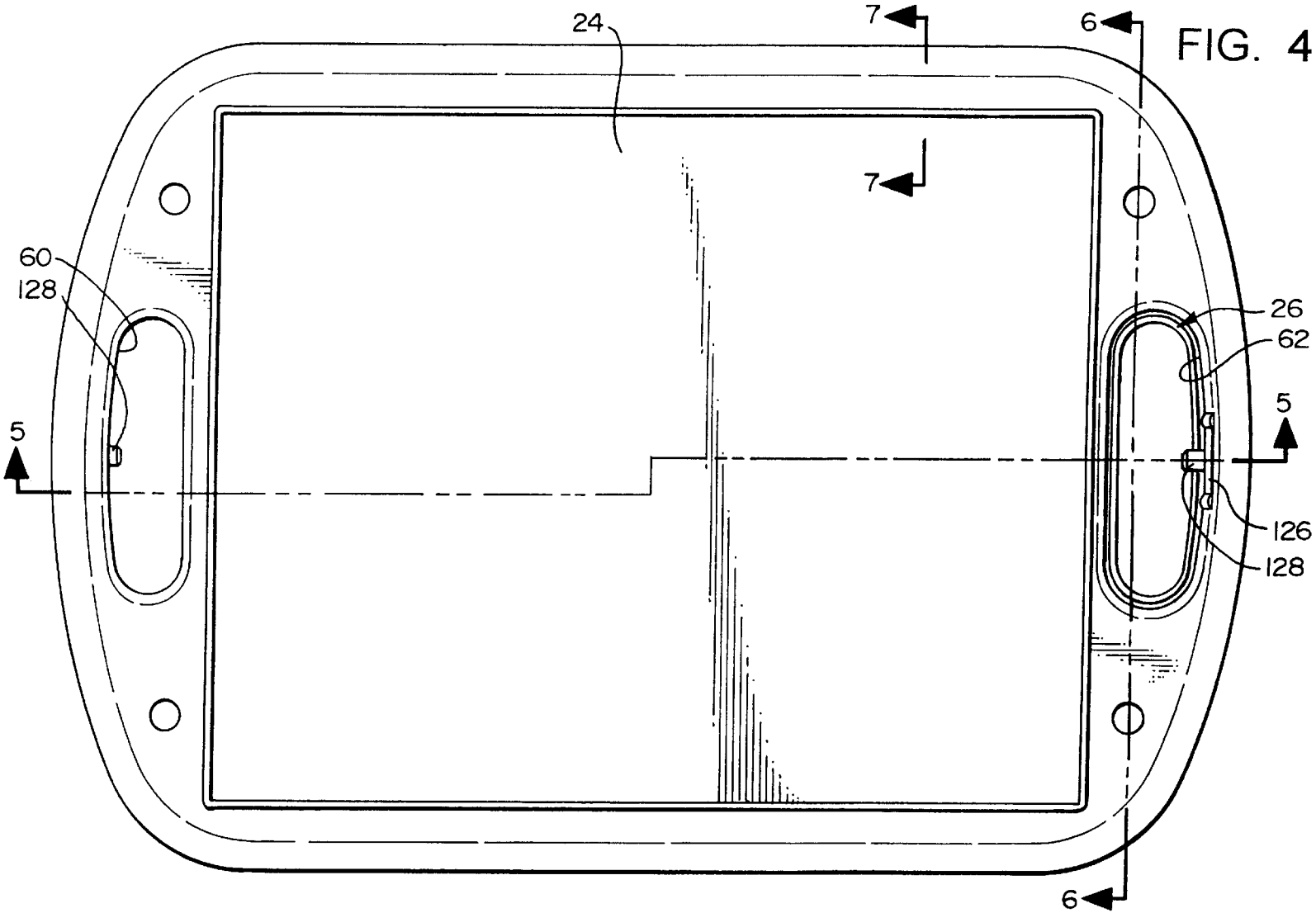
FIG. 4 is a top plan view of the system of FIG. 1.
Figure 5:
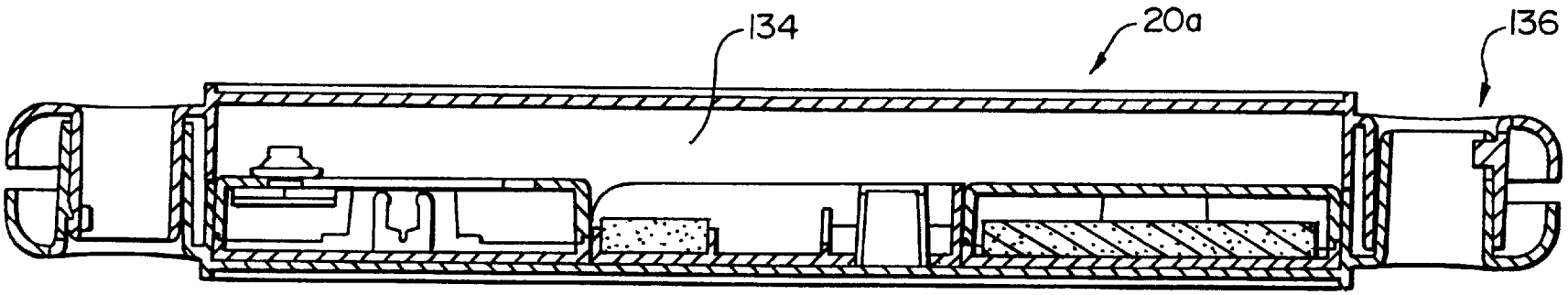
FIG. 5 is a section view taken along lines 5—5 in FIG. 4.
Figure 6:
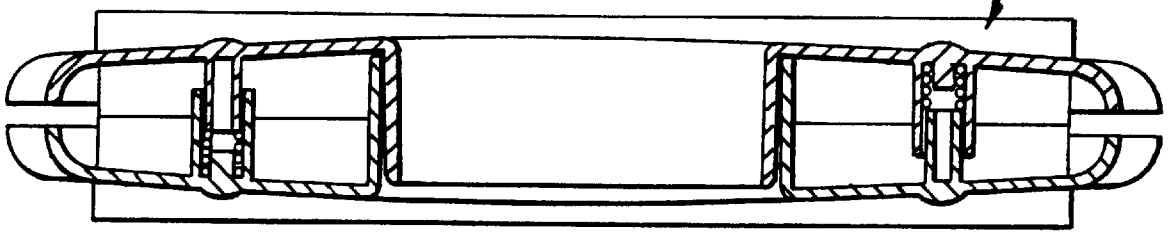
FIG. 6 is a section view taken along lines 6—6 in FIG. 4.

Referring now to FIGS. 4–10, the engagement of the lid member 24 with the base assembly 22 will now be discussed in detail. Referring initially to FIGS. 4–6, it can be seen that the first and second handle guides 60 and 62 are similar in configuration but that the first handle guide 60 is slightly smaller such that it can snugly fit within the handle passageway 74 defined by the second handle guide 62. Similarly, the sockets 68 and 80 and posts 64 and 66 are both similarly shaped (e.g., cylindrical) but have different diameters such that the posts 64 and 66 can snugly fit within the post chambers 76 and 78.

In use, the lid member 24 and base member 26, which are identical, are simply rotated 180° relative to each other, arranged such that the internal cavities 52 thereof face each other, and displaced such that the first handle guides 60 are received within the guide passageways by the second handle guides 62, the posts 64 are received within the socket chambers 78 of the sockets 70, the posts 66 are received within the socket chambers 76 of the sockets 68, and the release projection 128 is received within the latch slot 124.

With the lid member 24 and base member 26 so arranged, the internal cavities 52 face each other to define an internal chamber 134 that is substantially enclosed, the edges 58 of the outer wall flange portions 46 are closely adjacent to each other, and the internal flanges 88 are aligned and closely adjacent to each other.

Figure 7:
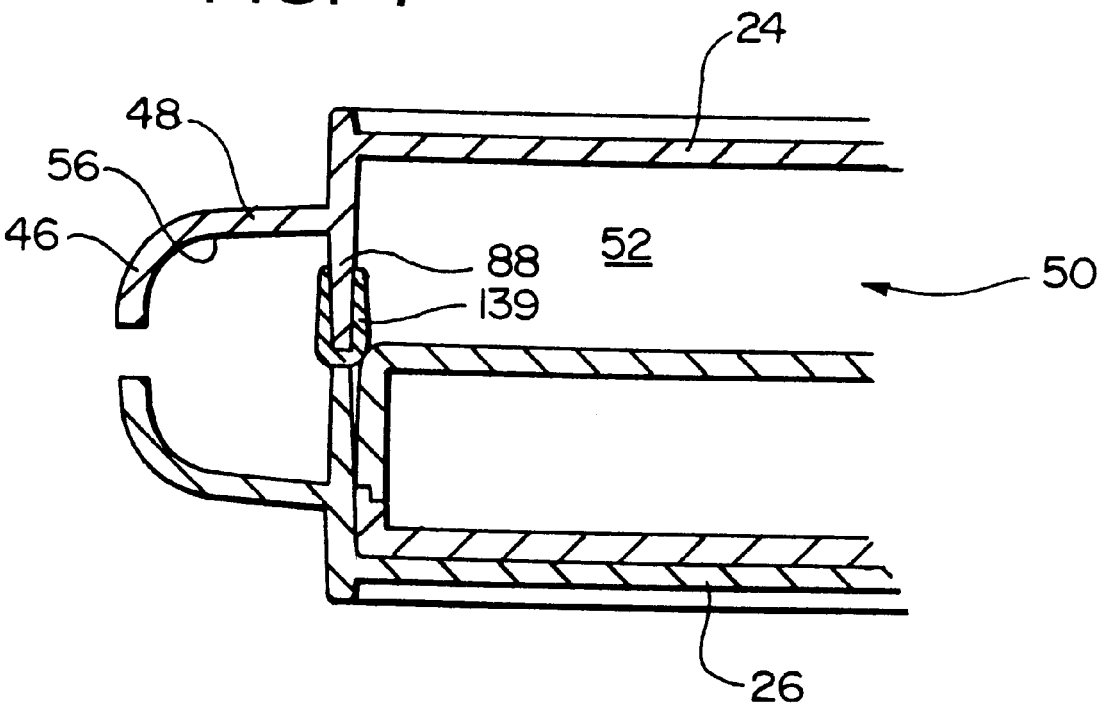
FIG. 7 is a section view taken along lines 7—7 in FIG. 4.
Figure 8:
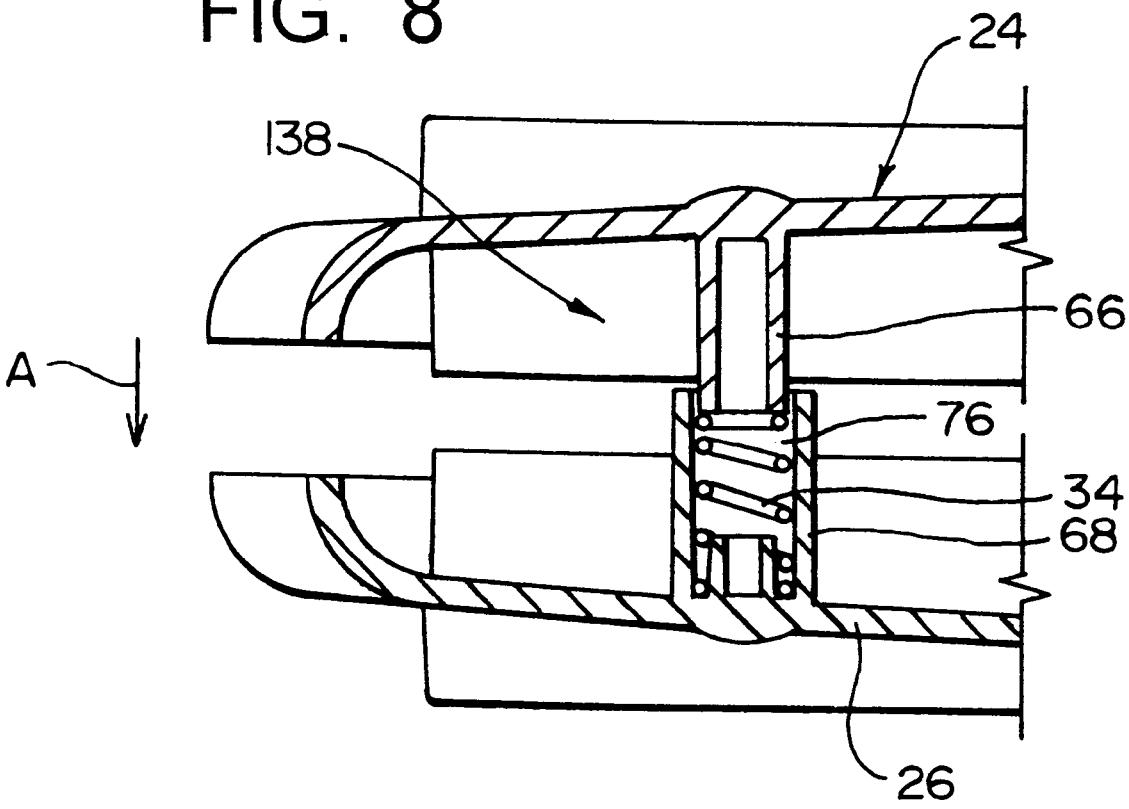
FIGS. 8 and 9 are section views taken along a portion of lines 6—6 in FIG. 4 depicting the function of stand-off springs employed by the system of FIG. 1.
Figure 9:
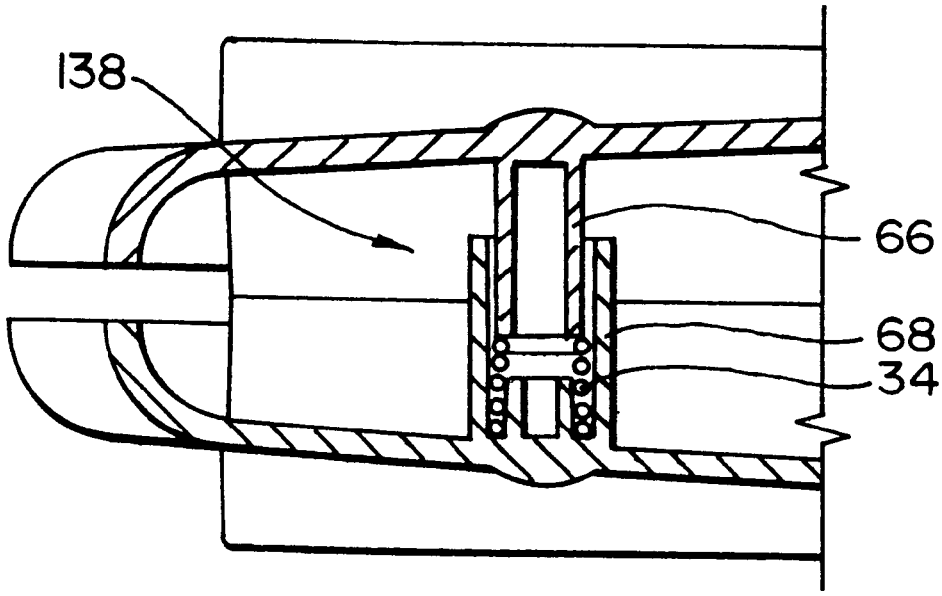

Referring now to FIGS. 5–7, depicted therein are the mechanical details of the interaction between the lid member 24 and the base member 26 when these members are in a closed configuration as shown in FIGS. 1, 4–9, and 11 to define an internal chamber 134. These members 24 and 26 as described above employ a locking system 136 (FIGS. 5, 10, and 11) and a guide/standoff system 138 (FIGS. 6, 8, and 9). The purpose of the locking system 136 is to positively but releasably lock the lid member 24 onto the base member 26. Although a preferred locking system 136 is shown and described herein, and this exemplary locking system 136 is optimized for use in the system 20, other locking systems may be used in place of the system 136.

When the lid member 24 is locked onto base member 26, the inner flanges 88 of the members 24 and 26 are closely adjacent to each other to define the chamber 134. An optional seal 139 may be attached to one or both of the members 24 and 26 to seal the chamber 134 if desired.

The guide/standoff system 138 serves at least two purposes: first, it guides the lid member 24 onto the base member 26 such that the internal flanges 88 are aligned with each other as the lid member 24 is attached to the base member 26; second, it applies a biasing force on the lid member 24 away from the base member 26. This biasing force assists the locking system 136 and improves the function of the system 20 when used in its second mode 20*b*. The guide/standoff system 138 may be formed by two independent systems, one for guiding and one for applying the biasing force, but can be simply and effectively implemented using the exemplary guide/standoff system 138. The guide/standoff system 138 itself is optional, however, and the system 20 can be used without this system in either of its two modes.

Referring initially to the exemplary guide/standoff system 138, this system 138 is formed by the first and second handle guides 60 and 62, first and second posts 64 and 66, first and second sockets 68 and 70, and the first and second standoff springs 32 and 34. The standoff springs 32 and 34 are placed in the sockets 68 and 70 of the base member 26.

When the system 20 is its closed configuration, the first handle guides 60 are received within the second handle guides 62, the first posts 64 are received within the second sockets 70, and the second posts 66 are received within the first sockets 68. All of the surfaces of these various portions of the members 24 and 26 that contact each other as the system 20 is placed into its closed configuration are substantially parallel to each other and to a direction A (FIG. 8) in which the lid member 24 is displaced to attach it to the base member 26.

Guides 60 and 62, posts 64 and 66, and sockets 68 and 70 of the lid and base members 24 and 26 thus interact to guide the lid member 24 onto the base member 26 such that the internal surfaces 56 of the outer wall box portions 50 are maintained substantially parallel to each other as the lid member 24 is moved into the closed configuration. While this is not critical when the system 20 is used in its first mode 20*a*, it is important when the system 20 is used in its second mode 20*b*.

As shown in FIGS. 8 and 9, the posts 60 and 62 engage and compress the standoff springs 32 and 34 as the posts 66 and 68 enter the socket chambers 76 and 78. The standoff springs 32 and 34 thus oppose movement of the lid member 24 towards the base member 26 as the lid member 24 is moved in the direction shown by arrow A. And when the lid system 20 is in the closed configuration, the compressed standoff springs 32 and 34 exert a static biasing force on the lid member 24.

Figure 10:
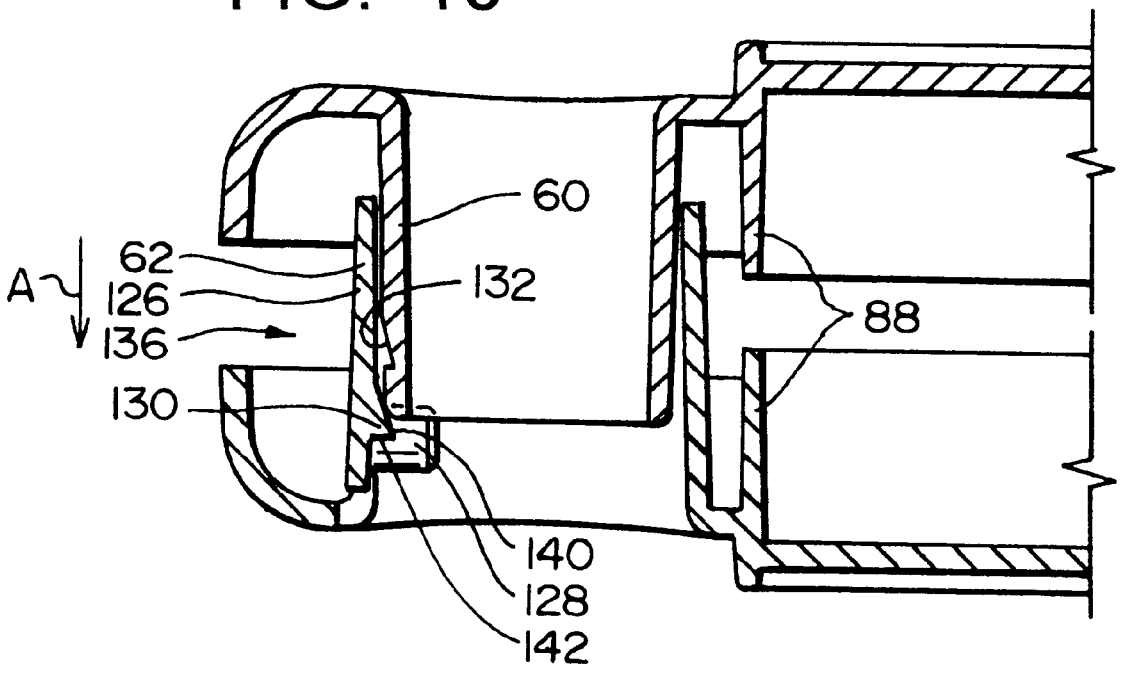
FIGS. 10 and 11 are section views taken along a portion of lines 5—5 in FIG. 4 depicting the operation of a locking mechanism employed by the system of FIG. 1.
Figure 11:
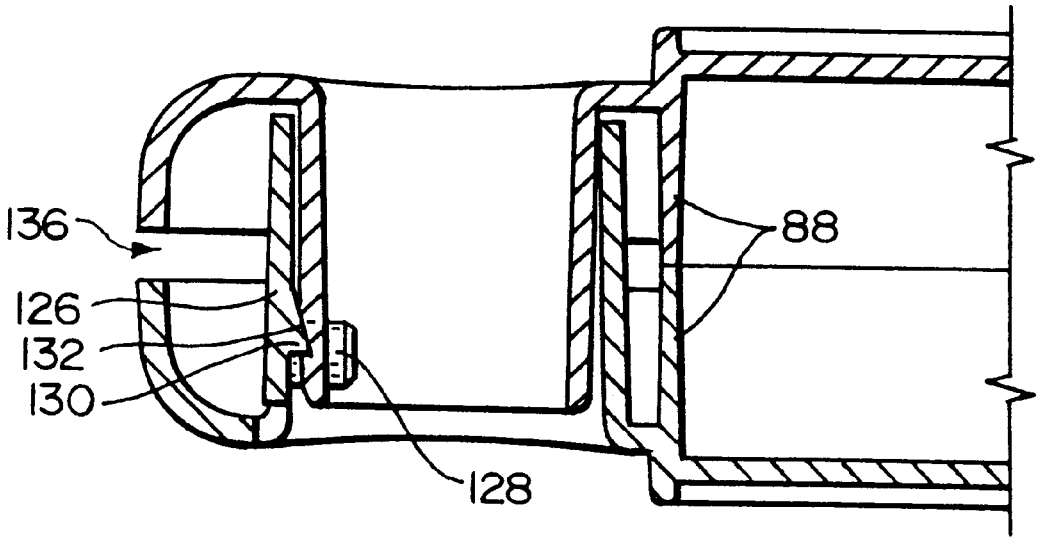

Referring now to FIGS. 10 and 11, these figures show the details of the exemplary locking system 136. In particular, as shown in FIG. 10 the detent projection 130 is shaped such that, when the lid member 24 is displaced onto the base member 26 as shown by arrow A, the first handle guide 60 engages a slanted surface 140 on the latch member 124 and deflects this member 124 outwardly. This allows the projection 130 to enter the detent groove 132. At that point, a horizontal surface 142 on the detent projection 130 engages the detent groove 132 to prevent the lid member 24 from moving away from the base member 26.

To remove the lid member 24, the release projection 128 is pushed such that the latch member 124 deforms and the surface 142 no longer engages the groove 132. As soon as this occurs, the biasing force applied by the standoff springs will move the lid member 24 until it is in the position shown in FIG. 10 relative to the base member 26.

Referring back to FIG. 2 and to FIGS. 12–18, the function of the system 20 in its first mode 20*a* will be described in further detail. Attached to the base member 26 are first, second, and third tray members 150, 152, and 154. The first tray member 150 is of a type that will be referred to as a staging tray. The second tray member 152 is an inking tray. The third tray member 154 is an ink pad tray.

These trays all comprise first and second tabs 156 and 158 that engage the attachment slots 120 to form a pressure fit that attaches the trays to the base member 126. The relief grooves 122 allow the interior flange 88 to deflect slightly as the tabs 156 and 158 enter the slots 120 to increase the pressure that holds the trays onto the base member.

Figure 15:
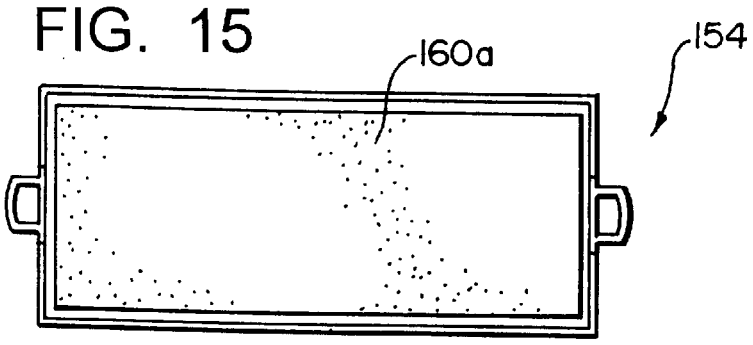
FIGS. 15–17 are top plan views depicting variations of ink-impregnated absorbent pads that may be contained by tray members of the system of FIG. 1.
Figure 16:
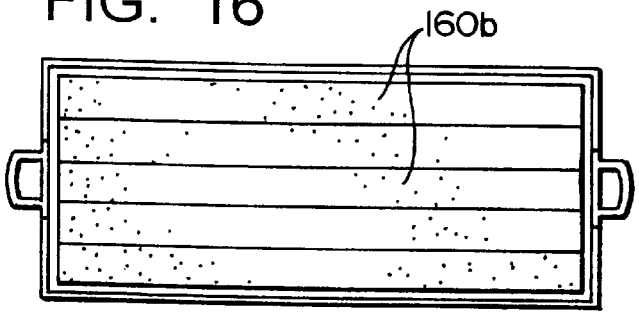
Figure 17:
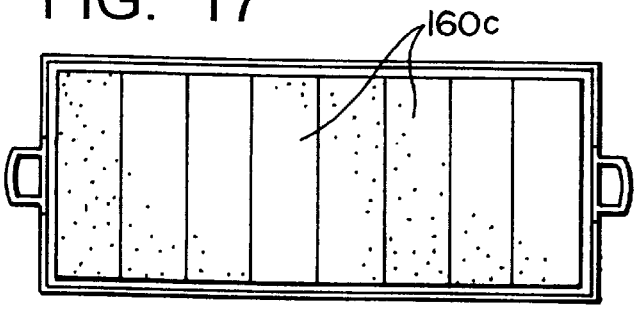
Figure 18:
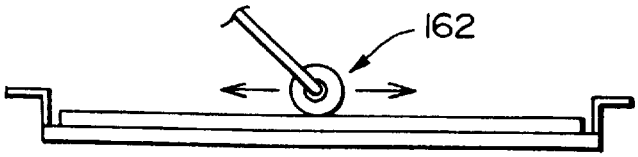
FIG. 18 is a side elevational view depicting the use of the ink-impregnated pads contained by the tray members of FIGS. 15–17.

FIGS. 15–18 show different variations of the ink pad tray 154 that illustrate that one or more absorbent pads 160 impregnated with ink may be arranged in the tray 154. FIG. 15 shows a single pad 160*a*, FIG. 16 shows a plurality of lengthwise pads 160*b*, and FIG. 17 shows a plurality of widthwise trays 160*c*. FIG. 18 shows the use of a stamp roller 162 to pick up ink from the pads 160*b* so that ink may be applied from the roller 162 in a striped configuration.

FIG. 2 shows that the inking tray 152 comprises a series of projections 164 that form a plurality of bottle slots 166 and a series of ink wells 168. The bottle slots 166 are sized and dimensioned to snugly receive conventional bottles 170 of ink. The ink wells 168 may be empty as shown at 168*a* or contain an ink-impregnated absorbent pad as shown at 168*b*. Ink may be placed into the empty ink wells 168*a* for subsequent application to a rubber stamp as will be described below.

FIGS. 2 and 12–14 show that the staging or docking tray 150 holds a stylus 172 and a plurality of inking tips 174. The stylus 172 contains first and second ends 176*a* and 176*b* having slots 178 and 180 formed therein. A middle portion 182 of the stylus 172 is thick in the middle and narrow towards the ends 176*a* and 176*b*.

Extending from the tray 150 are first and second retaining clips 184 and 186 that are slotted to receive the ends 176*a* and 176*b* of the stylus 172 and attach the stylus 172 to the tray 150 using an interference fit. By simply lifting on one end of the stylus 172, the end can be removed from the slot in the one of the clips 176*a* and 176*b*. The other end will simply glide out of the other clip because of the narrowing of the stylus 172 towards the ends. The distance between the clips 184, 186 relative to the thickness of the stylus 182 is predetermined to ensure a proper fit.

Figure 12:
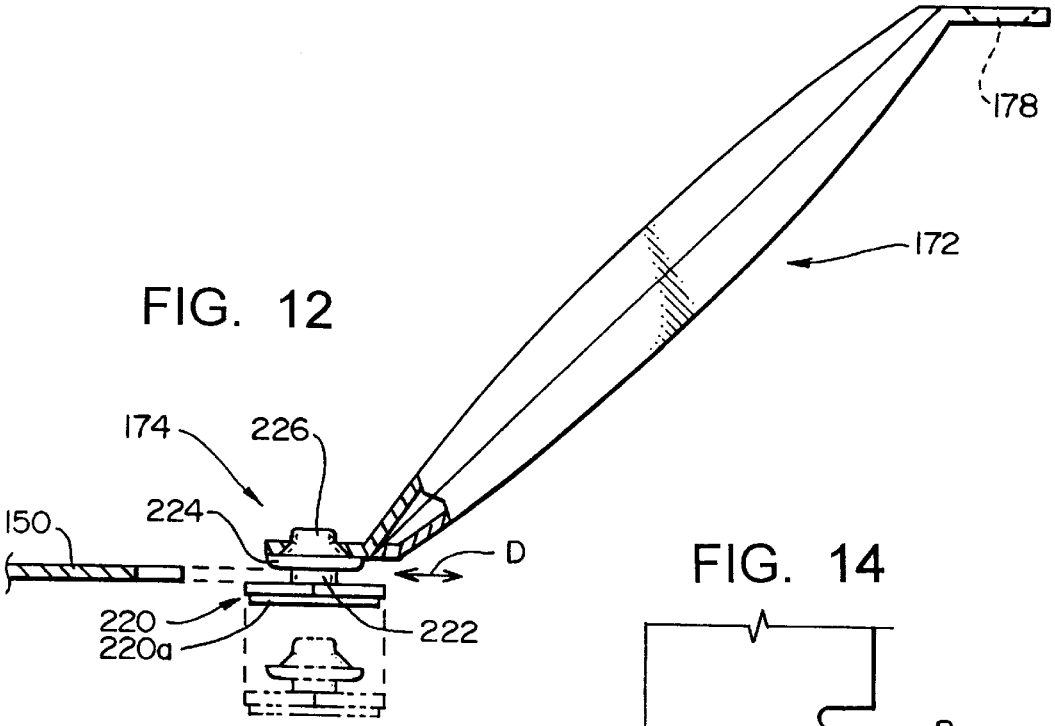
FIGS. 12 and 13 are side elevational views depicting the operation of a docking portion of the system of FIG. 1.

As perhaps best shown in FIG. 12, the inking tips 174 have an inking portion 220, a tray or docking portion 222, a spacing portion 224, and a stylus portion 226.

The inking portion 220 can be configured in a number of ways. This portion 220 will usually, but need not, comprise an inking layer 220*a*. The inking layer 220*a* may be a soft foam material that is adapted to pick up ink from an ink pad 160 or 168*b* or from within the wells 168*a* and apply it to a target surface. In this case, the target surface may be the surface of an ink pad that will in turn be brought into contact with a surface on which an ink impression is to be formed or the target surface may be the surface on which the ink impression is to be formed. The inking layer 220*a* may also be hard foam material such as that used to form a rubber stamp, in which case the target surface will usually be the surface on which the ink impression is to be formed. The inking layer 220*a* may also be a moldable foam material as will be described in further detail below with reference to FIGS. 21–24.

The inking portion 220 also has a relatively large cross-sectional area when compared to the tray or docking portion 222. Thus, when the stylus 172 is disengaged from the tip 174 as will be discussed below, the inking portion engages the tray 150 to prevent the tip 174 from moving up.

The stylus portion 226 is adapted to be received within the grooves 178 and 180 in the ends of the stylus so that the stylus carries the tip 174 for ease of applying ink. The exemplary spacing portion 224 has a larger cross-sectional area than either the tray portion 222 or the stylus portion 226.

The spacing portion 224 simply spaces the inking portion from the tray or docking portion 222 and engages the staging tray 150 to support the tip 174.

The tray portion 222 of the tip 174 is adapted to be received in docking grooves 228 (FIGS. 2 and 14) formed in the staging tray 150 to attach tip 174 to the tray 150. Relief slits 230 are formed on either side of each of the grooves 228 such that, as the tray portion 222 enters the groove 228, it acts on restrictions 232 formed on either side of the groove 228. These restrictions 232 are formed on relief portions 234 defined between the groove 228 and the slits 230 on either side thereof. The relief portions 234 deflect slightly as shown by arrows B in FIG. 14 to allow the tray portion 222 of the tip 174 to enter the groove 228. The restrictions 232 then act on the tray portion 222 to prevent inadvertent removal of the tip 174.

When the stylus 172 is moved in a lateral direction (parallel to arrow D in FIG. 12), the friction fit formed between the stylus portion 226 of the tip 174 and the stylus 172 is greater than the retaining force applied by the restrictions 232 on the tray portion 222 of the tip 174 that holds the tip 174 within the groove 228. But when the stylus 172 is moved in a vertical direction (parallel to arrow C in FIG. 13), the friction fit between stylus 172 and tip 174 is overcome because the tip 174 engages the relief portions 234, which allows the stylus 172 to be detached from the tip 174.

Figure 13:
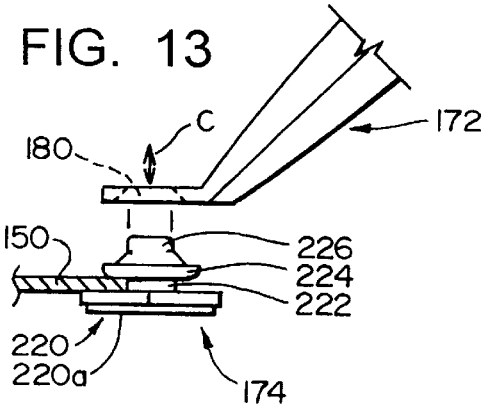
Figure 14:
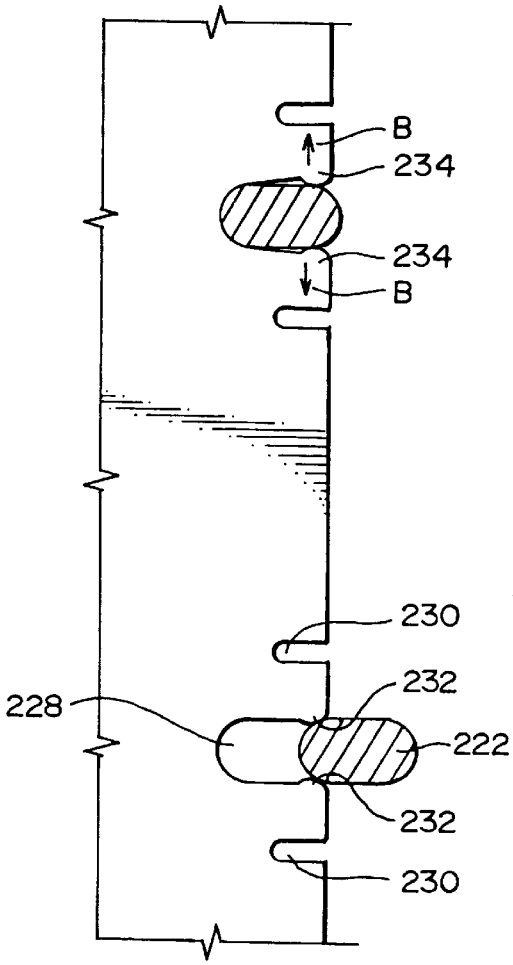
FIG. 14 is a top plan view depicting the operation of the docking portion of the system of FIG. 1.

The stylus 172 and tip 174 are used as follows. When a tip 174 is docked on the staging tray 150 as shown in FIG. 13, the stylus 172 is displaced towards the tip 174 along the line shown by arrow C until the stylus portion 226 of the tip 174 enters the slot 180 to form a friction fit that attaches the tip 174 to the stylus 172. The stylus 172 is split at the slot 180 such that it can deform slightly to allow the stylus 172 partially surrounds the stylus portion 226 in a plane orthogonal to the arrow C. In particular, the end 176 of the stylus 172 extends slightly more than half-way (180°) around the stylus portion 226 to form a positive mechanical attachment between the stylus 172 and the tip 174 in addition to the friction fit described above.

The stylus 172 is then displaced as shown by arrow D (FIG. 12) to remove the tip 174 from the tray 150. The positive mechanical attachment of the stylus 172 to the tip 174 is in the direction of arrow D (orthogonal to arrow C), so the stylus 172 does not detach from the tip 174 as the tip 174 detaches from the tray 150. The stylus with tip attached may then be used to apply ink, or serve another function, as desired. The process is simply reversed to replace the tip 174 onto the tray 150.

Figure 20:
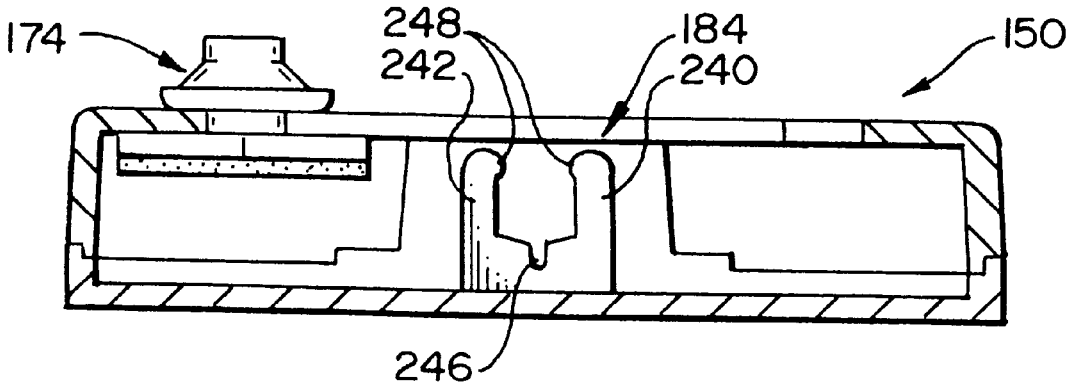
FIG. 20 is an end, cutaway view of the staging tray of FIG. 22.
Figure 21:
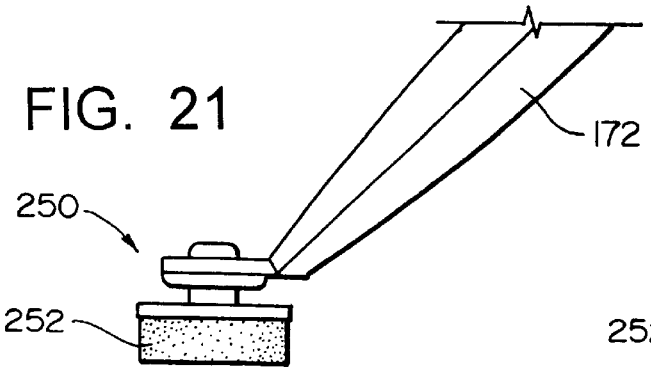
FIG. 21 is a side elevational view of a stylus assembly containing a moldable tip.

FIG. 19 shows a perspective view of the staging tray 150 illustrating that this tray 150 may be removed from the base assembly 22 and used independently therefrom. FIG. 20 shows that the retaining clips 184 and 186 comprise first and second clip projections 240 and 242; a relief cut 246 is formed in the clips 184 and 186 to facilitate movement of the clip projections 240 and 242 away from each other when the stylus 172 is attached to and detached from the tray 150. Restrictions 248 are formed on the projections 240 and 242 to hold the stylus 172 in place.

FIGS. 21–24 depict the construction and use of a moldable tip 250 that may be used with the stylus 172 in place of the exemplary tip 174 described above. The moldable tip 250 is constructed in most respects in a manner similar to the tip 174 described above. In particular, the tips 250 and 174 are similar in the manner in which they are attached to and detached from the tray 150 and stylus 172.

Figure 22:
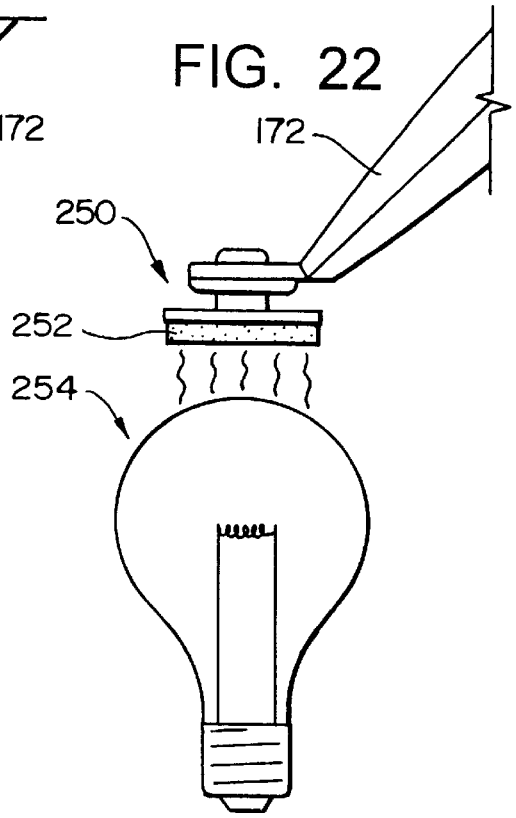
FIG. 22 is a side elevational view of the stylus assembly of FIG. 24 in which the moldable tip is being heated.
Figure 23:
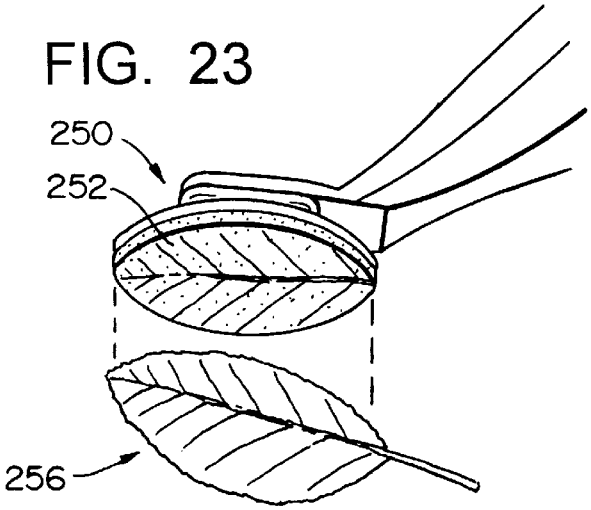
FIG. 23 is a perspective view of a first design being formed with a moldable tip such as that of the stylus of FIG. 24.
Figure 24:
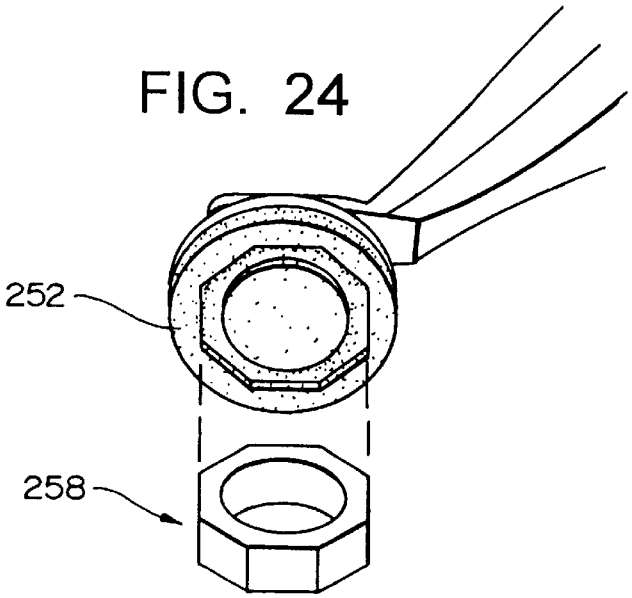
FIG. 24 is a perspective view of a second design being formed with moldable tip such as that of the stylus of FIG. 24.

The moldable tip 250 comprises a foam layer 252 that may be used by the art stamper to easily and inexpensively create a custom stamping surface. As shown in FIG. 22, the foam layer 252 may be heated by exposure to a heat source such as a light bulb 254. When sufficiently heated, the foam layer 252 becomes soft and pliable. The soft, pliable foam layer 252 can then be brought into contact with a source object such as a leaf 256 as shown in FIG. 23 or a nut 258 as shown in FIG. 24. The foam layer 252 takes on a shape that is the reverse of the source object and then retains this shape as it cools. The foam layer 252 can then be used in the same manner as a conventional hard foam rubber stamp to transfer ink to an image carrying member such as a sheet of paper or the like. The ink impression so formed will generally correspond to the physical contours of the source object.

The tips 174 or 250 can thus be configured both according to a function selected from a group of functions, such as ink pad, stamp pad, moldable stamp pad, paint brush, pen tip, stenciling tip, eraser, or the like, simply by attaching a desired functional layer or mechanism thereto. And within these functions, the tips 174 can be configured in shapes and colors selected from groups of shapes and colors. The optional staging tray 150, stylus 172, and tips 174 thus add significant flexibility to the overall use of the system 20, but the system 20 has significant functionality, as described below, when these members are not used.

Figure 25:
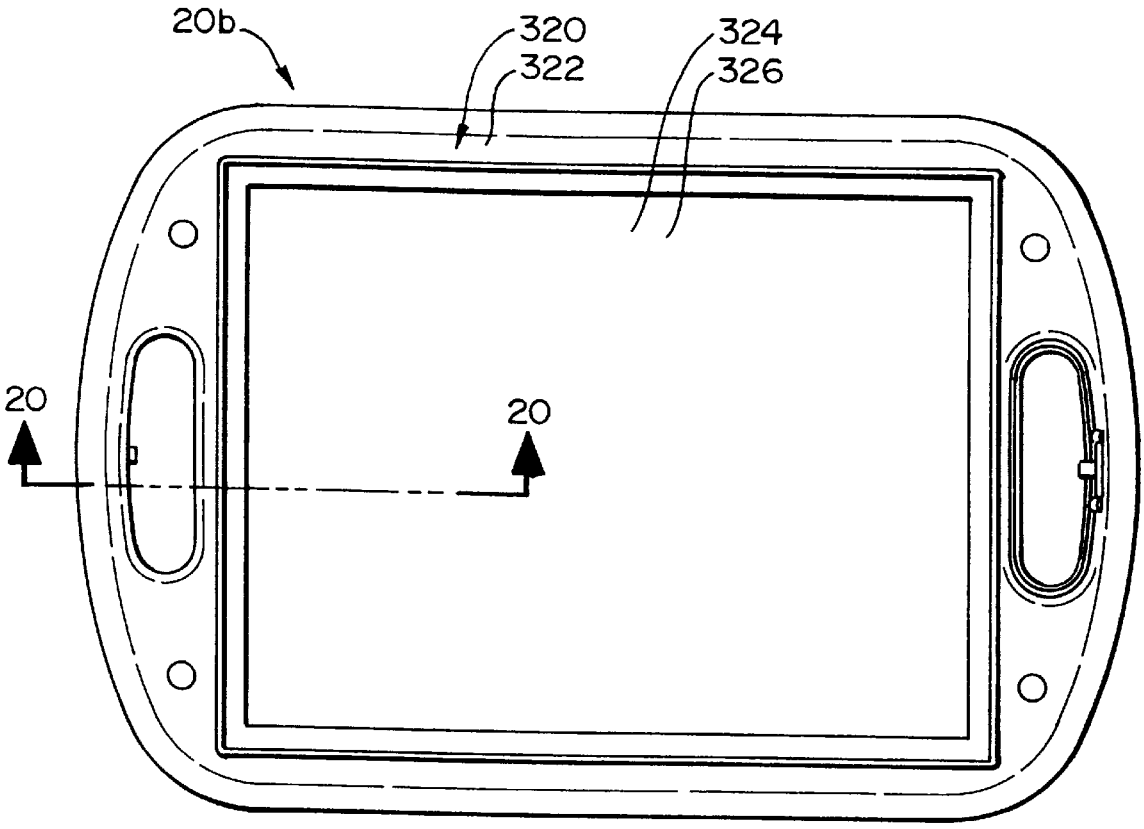
FIG. 25 is a top plan view depicting a second mode of using the stem of the present invention.
Figure 26:
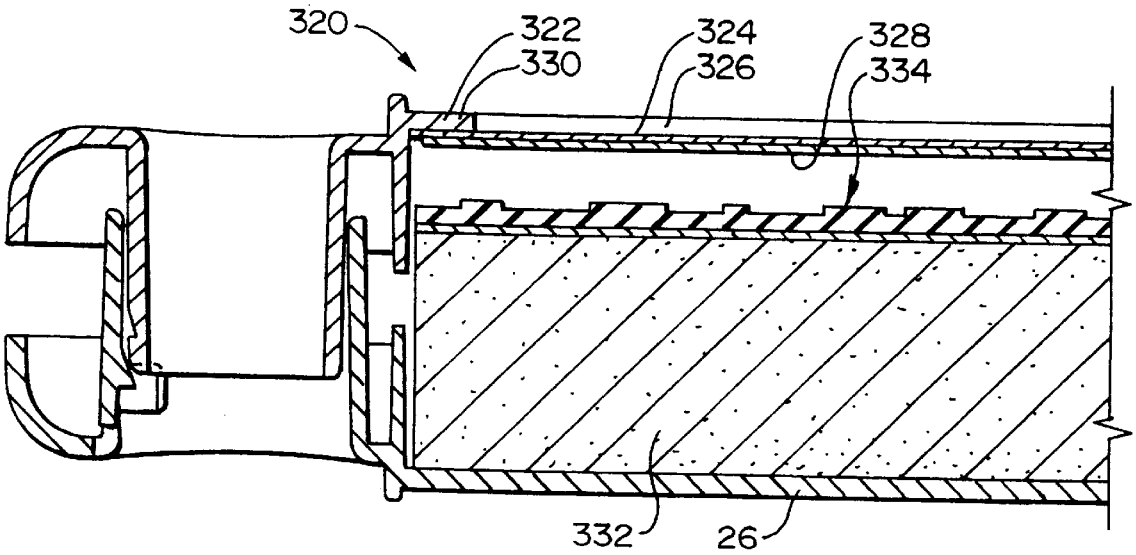
FIGS. 26 and 27 are section views taken along lines 20—20 in FIG. 19 depicting the use of the system of FIG. 19.
Figure 27:
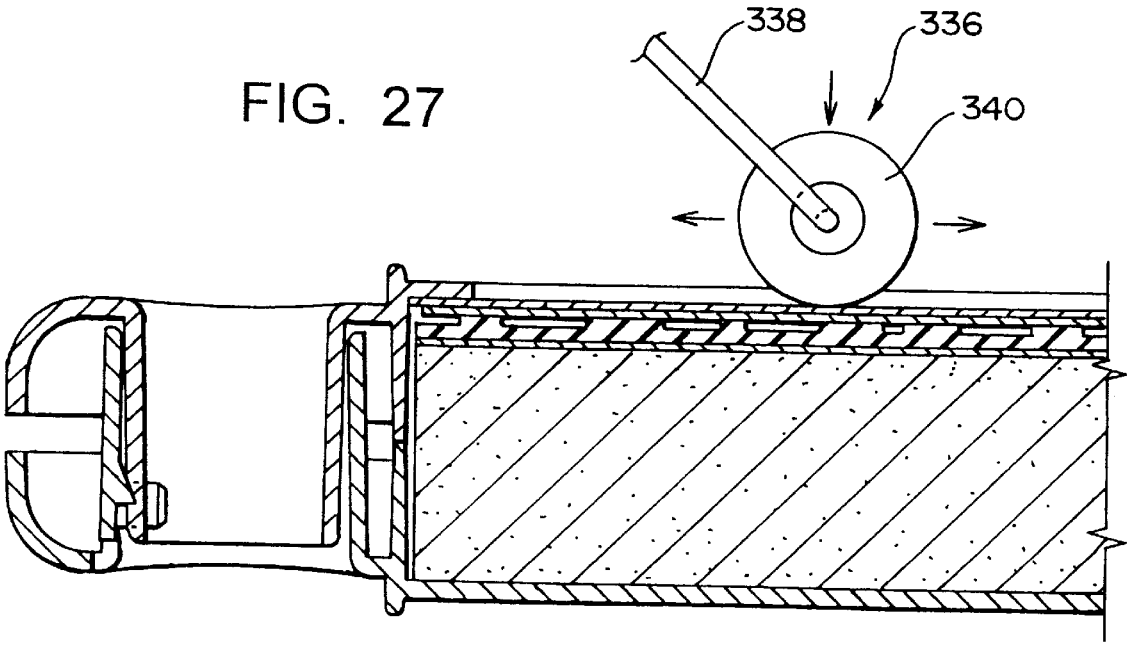

Referring now to FIGS. 25–27, the construction and use of the system 20 in its second mode **20*b* will now be described. In this second mode, the lid member 24 is replaced by a frame assembly 320 and the trays 150, 152, and 154 are removed from the base member 26**.

The frame assembly 320 comprises a frame members 322 and a brayer sheet 324. The frame member 322 is in most respects substantially identical to the lid member 24 except that an opening 326 is formed in the frame member 322. The frame member 322 attaches to the base member 26 in the same manner as the lid member and this will not be described in detail herein except to note where this manner of attachment yields benefits in this second mode.

The exemplary brayer sheet 324 is deformable and comprises a first structural layer for strength and a second adhesive layer to allow sheet material 328 (FIG. 20) to be attached thereto. A semi rigid material, such as cardboard, may be used as the structural layer, or a more flexible material, such as a fabric, held taught over the opening 326 may be used. These layers may be formed by a fabric sheet and a separate double sided adhesive sheet attached thereto or a fabric sheet sprayed with adhesive material.

The opening 326 is formed in the box portion 50 of the wall 44 of the frame member 322. The opening 326 is slightly smaller than the box portion 50 such that a perimeter frame 330 extends around the opening 326. The brayer sheet 324 is attached to the perimeter frame 330 such that the sheet 324 covers the opening 326 with the adhesive layer of the brayer sheet facing the internal cavity 52 of the frame member 322. While the entire opening 326 is covered by the exemplary brayer sheet 324, only a portion of the opening 326 as necessary to support the sheet material 328 need be covered.

Placed into the internal cavity 52 of the base member 26 is a rubber stamp member 332. This rubber stamp is generally conventional except that it has a surface area that can be quite large, and is typically on the order of less than 9.5" by 12". The rubber stamp member 332 has an inked surface 334 to which ink has been applied. The inked surface 334 is textured such that, when paper or other sheet material is brought into contact therewith, the ink transfers to the paper to form an ink impression.

In the mode **20*b*, sheet material 328 is attached to the brayer sheet 324 and the stamp member 332, with ink on its inked surface 334, is placed into the internal cavity 52. The frame assembly 320 is then attached to the base member 26 in the same manner as the lid member 24. The guide/standoff system 138 helps to maintain the sheet material 328 substantially planar and parallel to the inked surface 334 as the frame assembly 320 moves down towards the base member 26**.

When the locking system 136 engages, the sheet material 328 is held closely adjacent to, or actually in contact with, the inked surface 334. With a large surface area stamp member, this contact may not be enough to transfer a desired quantity of ink to form an acceptable ink impression. Accordingly, a brayer assembly 336 is provided. This assembly 336 has a handle 338 and a roller member 340 rotatably attached thereto. The roller member 340 is rolled over the brayer sheet 328 to ensure that enough pressure is applied between the sheet material 328 and the inked surface 334 to ensure that a sufficient quantity of ink is transferred. It should be noted that the brayer sheet is flexible and deforms slightly as it is traversed by the roller member 340.

The locking system is then disengaged, and the standoff springs immediately force the frame assembly 320 upwards so that the sheet material 328 is cleanly and immediately removed from the inked surface 334. The guide system 138 ensures that the sheet material 328 does not move or chatter from side to side as the material 328 is removed; this substantially lessens the likelihood that the ink impression will be smudged. While the guide system 138 facilitates formation of an ink impression as just described, the guide system 138 is not essential, and the present invention can be implemented without a guide system.

The frame assembly 320 is then removed from the base member 24, at which point the sheet material 328 can be removed from the adhesive layer of the brayer sheet 324. In this respect, it should be noted that this adhesive layer is temporary only, but should be of sufficient strength to maintain the sheet material in a planar orientation during the printing process.

From the foregoing, it should be apparent that the present invention may be embodied in many different combinations and sub-combinations of the elements and steps described above. The scope of the present invention should thus be determined by the following claims and not the foregoing detailed description.

I claim:

1. A system for applying ink to a surface for the purpose of forming an ink impression, comprising:

a docking member defining at least one docking groove;

a tip member having a stylus portion, a docking portion, a spacing portion, and an ink carrying portion adapted to apply ink to the surface, where the docking portion is adapted to be received by the docking groove to detachably attach the tip member to the docking member, where the tip member moves in a docking direction relative to the docking member as the tip member is being detachably attached to the docking member; and a stylus member having a handle portion and a tip slot for engaging the stylus portion of the tip member to detachably attach the tip member to the stylus member, where the stylus member moves in a stylus direction relative to the tip member as the stylus member is being detachably attached to the tip member; wherein the stylus member is grasped and displaced to attach the tip member to the stylus member, then further displaced to detach the tip member from the docking member, and then further displaced to bring the tip member into contact with the surface;

when the tip member is attached to the docking member, the docking direction is substantially orthogonal to the stylus direction; and when the tip member is attached to the docking member, the ink carrying portion prevents the tip member from moving relative to the docking member in the stylus direction and the spacing portion prevents the tip member from moving relative to the docking member in a direction opposite to the stylus direction.

2. A system as recited in claim 1, in which at least one relief slit is formed in the docking member adjacent to the docking groove to allow the docking member to deform to allow the docking portion of the tip member to enter and exit the docking groove.

3. A system as recited in claim 2, where a land is formed on the docking member between the docking groove and the relief slit, where the land moves to allow the docking portion of the tip member to enter and exit the docking groove.

4. A system as recited in claim 3, in which a restriction is formed on the land, where the restriction acts on the docking portion of the tip member when the tip member is attached to the docking member to inhibit inadvertent removal of the tip member from the docking member.

5. A system as recited in claim 1, in which the ink carrying portion of the tip member is an absorbent pad that is impregnated with ink and the surface is formed on a rubber stamp member for forming the ink impression.

6. A system as recited in claim 1, in which the ink carrying portion of the tip member is a rubber stamp member for forming the ink impression.

7. A system as recited in claim 1, in which the tip member is configured such that the docking portion is arranged between the ink carrying portion and the stylus portion.

8. A system as recited in claim 7, in which the tip member further comprises a spacing portion arranged between the docking portion and the stylus portion.

9. A system as recited in claim 1, in which the ink carrying portion is a heat formable layer that is malleable when heated and relatively rigid when cool, where the heat formable layer is heated, brought into contact with an object, allowed to cool in the shape of the object, brought into contact with ink, and then brought into contact with the surface to form the ink impression having characteristics of the object.

10. A system for applying ink to a surface for the purpose of forming an ink impression, comprising:

a docking member defining at least one docking groove and at least one relief slit adjacent to the docking groove;

a tip member having a stylus portion, a docking portion, and an ink carrying portion adapted to apply ink to the surface, where the docking portion is adapted to be received by the docking groove to detachably attach the tip member to the docking member; and a stylus member having a handle portion and a tip slot for engaging the stylus portion of the tip member to detachably attach the tip member to the stylus member; wherein the stylus member is grasped and displaced to attach the tip member to the stylus member, then further displaced to detach the tip member from the docking member, and then further displaced to bring the tip member into contact with the surface; and the relief slit allows the docking member to deform to allow the docking portion of the tip member to enter and exit the docking groove.

11. A system as recited in claim 10, where a land is formed on the docking member between the docking groove and the relief slit, where the land moves to allow the docking portion of the tip member to enter and exit the docking groove.

12. A system as recited in claim 11, in which a restriction is formed on the land, where the restriction acts on the docking portion of the tip member when the tip member is attached to the docking member to inhibit inadvertent removal of the tip member from the docking member.

13. A system for applying ink to a surface for the purpose of forming an ink impression, comprising:

a docking member defining a plurality of docking grooves;

a plurality of tip members each having a stylus portion, a docking portion, and an ink carrying portion adapted to apply ink to the surface, where the docking portion is adapted to be received by one of the docking grooves to detachably attach the tip member to the docking member; and a stylus member having a handle portion, first and second end portions, and a tip slot formed in each of the first and second end portions, where the tip slots engage the stylus portions of the tip members to detachably attach the tip members to each end of the stylus member; wherein the stylus member is grasped and displaced to attach one of the tip members to each of the first and second tip slots in the stylus member.

* * * * *